US005194016A

United States Patent [19]

Hatagishi et al.

[11] Patent Number: 5,194,016

[45] Date of Patent: Mar. 16, 1993

[54] CONNECTION-CONDITION CHECKABLE CONNECTORS

[75] Inventors: Yuji Hatagishi; Naoto Taguchi, both of Shizuoka, Japan

[73] Assignee: Yazaki Corporation, Japan

[21] Appl. No.: 770,937

[22] Filed: Oct. 4, 1991

[30] Foreign Application Priority Data

Oct. 4, 1990 [JP] Japan ..... 2-104011[U]

[51] Int. Cl.[5] ..... H01R 3/00

[52] U.S. Cl. ..... 439/489; 439/354

[58] Field of Search ..... 439/488, 489, 350, 352, 439/354, 357; 235/464, 462, 469

[56] References Cited

U.S. PATENT DOCUMENTS 4,902,244 2/1990 Endo et al. ..... 439/489
4,950,179 8/1990 Takenouchi et al. ..... 439/357
5,055,058 10/1991 Nagasaka et al. ..... 439/489

FOREIGN PATENT DOCUMENTS 63-225480 9/1988 Japan .
0109671 4/1989 Japan ..... 439/489

*Primary Examiner*—Larry I. Schwartz
*Assistant Examiner*—Hien D. Vu
*Attorney, Agent, or Firm*—Wigman & Cohen

[57] ABSTRACT

Connection-condition checkable connectors to be electrically interconnected are provided with a pair of connector members to be interconnected. One of the connector members is provided with a cantilever-like resilient detection arm extending in a longitudinal axis which is coincident with a line along which the connector members are moved to be interconnected. In order to resiliently deform the detection arm in connecting operation so as to move the same temporarily in a direction substantially perpendicular to the line, and then to permit the detection arm to return to its original position, the detection arm has a projection and the other of the connector members has a counter projection. A plurality of detection marks are provided for the detection arm and the other of the connector members so as to be arranged side by side in a direction perpendicular to the line.

3 Claims, 5 Drawing Sheets

CONNECTION-CONDITION CHECKABLE CONNECTORS

BACKGROUND OF THE INVENTION

1. Field of the Invention

The present invention relates to a pair of soft-shell connectors (which consist of a male one and a female one) enabling a user to check to see if the connectors are precisely connected with each other (hereinafter referred to as the connection-condition checkable connectors).

2. Description of the Prior Art

For example, ones of conventional soft-shell connectors of this kind, i.e., conventional connection-condition checkable connectors are shown in FIG. 1, which are disclosed in detail in Japanese Patent Laid-Open No. Sho 63-225480.

Such conventional checkable connectors consist of a male one 1 and a female one 3. The male connector 1 is provided with at least one female contact (not shown), while the female connector 3 is provided with at least one male contact (not shown). The male connector 1 has a housing 5 provided with a lock arm 9. The lock arm 9 is, as shown in FIG. 2, provided with a projection 7 forming a part of a locking mechanism of the connectors. On the other hand, the female connector 3 has a hood 11 provided with a counter projection 13 which forms the remaining part of the locking mechanism of the connectors.

In the male connector 1, a plurality of detection marks 15 (each of which assumes a convex shape in cross section as shown in FIG. 2) are integrally formed with a rear-end portion 9*a* of the lock arm 9 so as to be disposed on the portion 9*a* at equal intervals along a longitudinal direction of the lock arm 9.

On the other hand, on an upper surface of the hood 11 of the female connector 3 are integrally formed a plurality of detection marks 17 each of which assumes the same form as that of each of the detection marks 15 of the male connector 1.

In checking operation of the detection marks 15 and 17, a detecting unit such as a photosensor and the like (which is provided with a photo-emitter portion and a photo-receiver portion) for detecting arrangement of the detection marks 15 and 17 is used. In operation, the detecting unit detects the arrangement of these marks 15 and 17 to issue an arrangement signal to a computer of the detecting unit. In the computer of the unit, the signal thus issued from the unit is first converted into a detected pattern and then compared with a predetermined reference pattern stored in the computer, so that the computer determines whether or not the detected pattern is coincident with the reference pattern to enable the unit to determine whether or not the projection 7 of the lock arm 9 of the male connector 1 is completely engaged with the counter projection 13 of the hood 11 of the female connector 3, i.e., to determine whether or not these male and female connectors are completely connected with each other.

In the conventional checkable connectors, however, after the connectors are completely connected with each other, a gap "a" is produced in the longitudinal direction of the lock arm 9 of the male connector 1 between the male connector 1 and the female connector 3, as shown in FIG. 2. Namely, in connecting operation of the connectors for inserting the male connector 1 into the female connector 3 to have a front end of the male connector 1 abut on an innermost end of the female connector 3 as shown in FIG. 2, the lock arm 9 is first resiliently deformed to move the projection 7 of the arm 9 to a position indicated in phantom line as shown in FIG. 3, and thereafter the projection 7 returns to its original position indicated in solid line (shown in FIG. 3) through a curved path indicated by an arrow shown in FIG. 3.

Due to such curved path of the projection 7 in the female connector 3, the presence of the gap "a" between the connectors having been connected with each other is inevitable. Consequently, in the thus connected connectors, as is clear from FIG. 4, the gap "a" may be produced between the front end of the male connector 1 and the innermost end of the female connector 3. Due to the presence of such gap "a" in the connectors having been connected with each other, a space (in the longitudinal direction of the lock arm 9 of the male connector 1) between the detection mark 15 of the male connector 1 and the detection mark 17 of the female connector 3 varies in amount within a range of from d to (d+"a") as is clear from FIGS. 2 and 4, to make it difficult to precisely check the detection marks 15, 17. Therefore, in the conventional checkable connectors, there is a fear that the detecting unit issues a false alarm to the user even when the connectors are completely connected with each other.

SUMMARY OF THE INVENTION

Under such circumstances, the present invention was made. Consequently, it is an object of the present invention to provide a pair of connection-condition checkable connectors free from any false alarm resulted from inadequate spacing of detection marks of the connectors.

According to a first aspect of the present invention, the above object of the present invention is accomplished by providing:

Connection-condition checkable connectors to be electrically interconnected, comprising:

a pair of connector members for being interconnected;

one of said connector members being provided with a cantilever-like resilient detection arm extending in a longitudinal axis which is coincident with a line along which said connector members are moved to be interconnected;

abutting means for resiliently deforming said detection arm in connecting operation so as to move said detection arm temporarily in a direction substantially perpendicular to said line, and then permitting said detection arm to return to its original position; and a plurality of detection marks being provided for said detection arm and the other of said connector members so as to be arranged side by side in direction perpendicular to said line.

Further, according to a second aspect of the present invention, the above object of the present invention is accomplished by providing:

Connection-condition checkable connectors to be electrically interconnected, comprising:

a pair of connector members for being interconnected;

one of said connector members being provided with a pair of cantilever-like resilient detection arms extending in a longitudinal axis which is coincident with a line along which said checkable connectors are moved to be interconnected;

abutting means for resiliently deforming said detection arms in connecting operation so as to move said detection arms temporarily in a direction substantially perpendicular to said line, and then permitting said detection arms to return to their original positions; and a plurality of detection marks being provided for said pair of said detection arms so as to be disposed side by side in a direction perpendicular to said line.

In addition, according to a third aspect of the present invention, the above object of the present invention is accomplished by providing:

Connection-condition checkable connectors to be electrically interconnected, comprising:

a pair of connector members for being interconnected;

one of said connector members being provided with a cantilever-like resilient detection arm extending in a longitudinal axis which is coincident with a line along which said connector members are moved to be interconnected;

abutting means for resiliently deforming said detection arm in connecting operation so as to move said detection arm temporarily in a direction substantially perpendicular to said line, and then permitting said detection arm to return to its original position; and a plurality of detection marks being provided for said detection arm and said one of said connector members so as to be arranged side by side.

In connecting operation of the checkable connectors of the present invention having the above constructions, since the detection arms of one of the connector members are first resiliently deformed and then return to their original positions after completion of connecting operation of the connectors, it is possible for the user of detecting unit (comprising a photosensor and the like) to determine whether or not the connector members are precisely connected with each other by checking the detection marks in arrangement, which marks are formed on the detection arms of one of the connector members. Namely, in case that the connector members are not precisely connected with each other, and, therefore the detection arms of one of the connector members remain deformed after completion of connecting operation, the detection marks formed on the detection arms are also deformed in arrangement. Such deformation in arrangement of the detection marks notices the user or detecting unit that the connector members are not precisely connected with each other. In the checkable connectors of the present invention, since the detection marks are so formed as to be equally spaced apart with each other in a lateral direction substantially perpendicular to the longitudinal axes of the detection arms, there is no fear that a gap (which exists between the connector members and extends in a longitudinal direction parallel to the longitudinal axes of the detection arms, in which longitudinal direction of the connector members are so moved as to be connected with each other) affects the detection marks in spacing or arrangement. Further, in some embodiments of the connectors of the present invention, the direction marks are formed in only one of the connector members. Consequently, in such some embodiments of the connectors, there is also no fear that the gap (which exists between the connector members and extends in a longitudinal direction parallel to the longitudinal axes of the detection arms, in which longitudinal direction the connector members are so moved as to be interconnected) affects the detection marks in spacing or arrangement.

Also, in other embodiments of the connectors of the present invention (in which the detection marks are formed in both of the detection arm and one of the connector members, with which one the detection arm is integrally formed), there is no fear that the above gap at affects the detection marks in spacing or arrangement.

The above object, additional objects, additional embodiments and advantages of the present invention will be clarified to those skilled in the art hereinbelow with reference to the following description and accompanying drawings illustrating preferred embodiments of the present invention according to principles of the present invention.

DESCRIPTION OF THE PREFERRED EMBODIMENTS

Hereinbelow, the present invention will be described in detail with reference to the accompanying drawings.

A first embodiment of the soft-shell type connection-condition checkable connectors of the present invention is shown in FIGS. 5 to 8.

Figure 5:
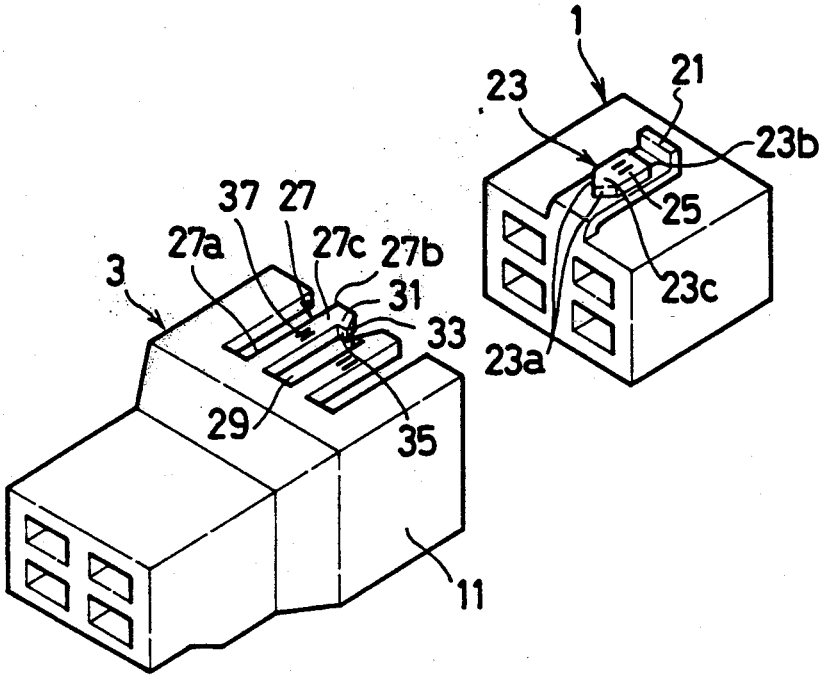
FIG. 5 is a perspective view of a first embodiment of the soft-shell type connection-condition checkable connectors of the present invention.
Figure 6:
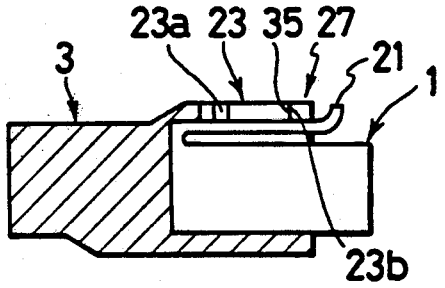
FIG. 6 is a longitudinal sectional view of the checkable connectors of the present invention shown in FIG. 5, illustrating the connectors having been connected with each other.

As is clear form FIG. 5, the connectors of the present invention consists of a male connector 1 and a female connector 3. In the male connector 1 is incorporated a female contact (not shown) which is brought into an electrical contact with a male contact (not shown) incorporated in the female connector 3. Each of the contacts is connected with a suitable conductor or wire. In connecting operation of the checkable connectors of the present invention, the male connector 1 is moved to the female connector 3 and inserted therein so that the female contact of the male connector 1 is brought into electrical contact with the male contact of the female connector 3.

In the first embodiment of the checkable connectors of the present invention, as shown in FIG. 5, the male connector 1 is provided with a cantilever-like lock arm 21. The arm 21 is integrally formed with a front-end portion of a shell or main body of the male connector 1 to have its free end extending rearward in a longitudinal direction in which the male connector 1 is moved to the female connector 3 so as to be connected therewith.

As is clear from FIG. 5, the lock are 21 of the male connector 1 is provided with an engaging projection 23 in a substantially intermediate portion thereof. In connecting operation of the checkable connectors of the present invention, the engaging projection 23 of the lock arm 21 cooperates with a pair of detection arms 27 of the female connector 3. Each of the detection arms 27 is provided with a hook portion 31 in its front end. The engaging projection 23 of the male connector 1 and the hook portions 31 of the female connectors 3 cooperate with each other to form an abutting means of the checkable connectors of the present invention.

More particularly, the engaging projection 23 of the male connector 1 has its front-end surface 23*a* tapered. The thus tapered surface 23*a* of the engaging projection 23 of the male connector 1 acts as a wedge means for increasing a clearance between the detection arms 27 of the female connector 3 so as to permit the projection 23 of the male connector 1 to pass through the thus increased clearance in connecting operation of the connectors. Further, in construction, the engaging projection 23 of the male connector 1 has: its rear surface 23*b* fattened; and its upper surface 23*c* marked with a pair of bar-shaped detection marks 25 which are disposed side by side in a lateral direction perpendicular to a longitudinal axis of the lock arm 21 of the male connector 1, which axis extends in the above-mentioned longitudinal direction (in which the male connector 1 is moved to the female connector 3 and inserted therein in connecting operation of the connectors).

On the other hand, as shown in FIG. 5, the female connector 3 is provided with the pair of the detection arms 27 in its hood portion 11. Each of the detection arms 27 has its free end (which forms the hook portion 31) extending from a closed end of the hood portion 11 in the longitudinal direction in which the male connector 1 is moved to the female connector 3 so as to be connected therewith. As is clear from FIG. 5, in the female connector 3, the hood portion 11 and the detection arms 27 are integrally molded of one material so that the arms 27 are formed in an upper wall of the hood portion 11 as if the free ends 27*b* of the arms 27 are cut from the upper wall of the hood portion 11. A base end 27*a* of each of the detection arms 27 of the female connector 3 is integrally formed with the upper wall of the hood portion 11, so that each of the detection arms 27 assumes a cantilever-like form provided with the free end 27*b*.

Between the detection arms 27 of the female connector 3 is formed an engaging cavity 29 in which the engaging projection 23 of the male connector 1 is received after completion of the connecting operation of the connectors. Consequently, the engaging cavity 29 of the female connector 3 is so shaped as to be able to receive therein the corresponding engaging projection 23 of the male connector 1.

The hook portion 31 is formed in the free end 27*b* of each of the detection arms 27 of the female connector 3. In connecting operation, as the male connector 1 is moved to the female connector 3, the hook portions 31 of the detection arms 27 first have their guide surfaces 33 abut on the tapered front surface 23*a* of the engaging projection 23 of the male connector 1, and are then moved sideward by the projection 23 so as to resiliently deform the detection arms 27 sideward, whereby the engaging cavity 29 of the female connector 3 is enlarged to permit the engaging projection 23 of the male connector 1 to enter the cavity 29 of the female connector 3. Each of the hook portions 31 of the female connector 3 is provided with an engaging surface 35. The engaging surface 35 is brought into contact with the corresponding engaging surface or rear surface 23*b* of the male portion 1 after completion of connection of the connectors 1, 3. As is clear from FIG. 5, the hook portions 31 of the female connector 3 have the guide surfaces 33 forming: the largest clearance therebetween in the outermost end thereof; and a smallest clearance therebetween in the innermost end thereof.

In the female connector 3, a pair of detection marks 37 are formed on an upper surface 27*c* of each of the detection arms 27 so as to be disposed side by side in a lateral direction perpendicular to the longitudinal direction in which the male connector 1 is moved to the female connector 3 so as to be connected therewith. These detection marks 37 may be bar codes and the like.

Now, connecting operation of the checkable connectors 1, 3 of the present invention will be described.

Figure 7:
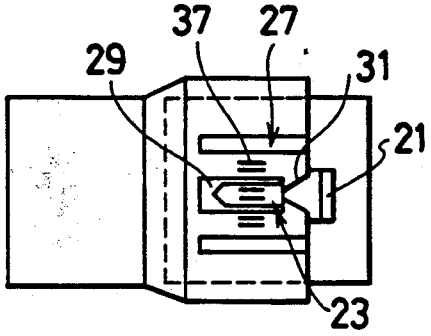
FIG. 7 is a plan view of the checkable connectors of the present invention shown in FIG. 5, illustrating the connectors having been connected with each other.
Figure 8:
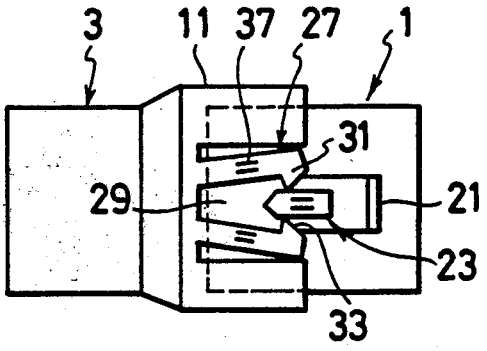
FIG. 8 is a plan view of the checkable connectors of the present invention shown in FIG. 5, illustrating the detection arms of the female one of the connectors having been resiliently deformed.

First of all, a front end of the male connector 1 is oppositely disposed from an opening of the hood portion 11 of the female connector 3. Then, the male connector 1 is moved to the female connector 3 and inserted therein. At this time, the tapered front surface 23*a* of the engaging projection 23 of the male connector 1 is brought into contact with the guide surfaces 33 of the detection arms 27 of the female connector 3. Then, as the male connector 1 is inserted into the female connector 3, as shown in FIG. 8, the hook portions 31 of the detection arms 27 of the female connector 3 are moved sideward so as to be separated from each other, whereby an entrance of the engaging cavity 29 of the female connector 3 is enlarged to permit the engaging projection 23 of the male connector 1 to enter the engaging cavity 29 of the female connector 3. Consequently, after completion of connection of the connectors 1 and 3, the engaging surface 23*b* of the engaging projection 23 of the male connector 1 abuts on the corresponding engaging surfaces 35 of the hook portions 31 of the male connector 1 to lock up the male connector 1 in the female connector 3. Under such circumstances: the female contact (not shown) incorporated in the male connector 1 is brought into electrical contact with the male contact (not shown) of the female connector 3; and, as shown in FIG. 7, the detection marks 37 of the detection arms 27 of the female connector 3 and those 25 of the engaging projection 23 of the male connector 1 are equally spaced apart from each other to give a suitable array of arrangement of the detection marks 37, 25 in the lateral direction perpendicular to the longitudinal direction in which the male connector 1 is moved to the female connector 3 and inserted therein. Consequently, in use, the above array or arrangement of the detection marks 37, 25 is detected by a suitable detecting unit provided with a photo-transmitter and a photoreceiver detect, so that the detecting unit issues a pattern signal representing the arrangement of the detection marks 37, 25 to a computer. In the computer, the arrangement or pattern of the marks 37, 25 is compared with a predetermined reference pattern having been stored in the computer so as to determine whether or not these two patterns are coincident with each other. Only in case that these two patterns are coincident with each other, the computer determines that the connectors 1, 3 are precisely connected with each other.

In connecting operation of the connectors 1 and 3, when the hook portions 31 of the detection arms 27 of the female connector 3 are forced to move sideward (as shown in FIG. 8) by the engaging projection 23 of the male connector 1, the pusher or user encounters a largest resistance to his effort to insert the male connector 1 into the female connector 3. Consequently, there is a fear that the user mistakes such largest resistance for abutting resistance produced upon completion of connection of the connectors 1, 3, and stops his effort by mistake. However, in case that the user stops his effort by mistake, the array of arrangement of the detection marks 37, 25 of the connectors 1, 3 having been incompletely connected with each other are considerably deformed as is clear from FIG. 8. The thus deformed arrangement of the detection marks 37, 25 of the connectors 1, 3 is easily detected by the detecting unit to enable the computer to determine that the connectors 1, 3 are incompletely connected with each other.

Figure 1:
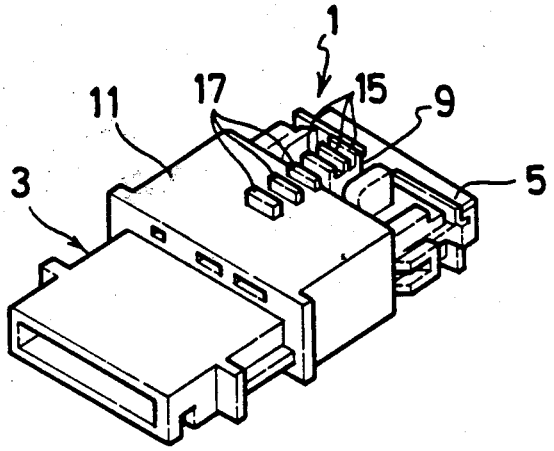
FIG. 1 PRIOR ART
FIG. 1 is a perspective view of the conventional connection-condition checkable connectors of soft-shell type.
Figure 2:
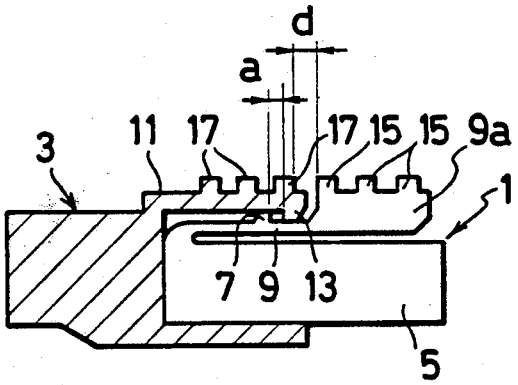
FIG. 2 PRIOR ART
FIG. 2 is a longitudinal sectional view of the conventional checkable connectors shown in FIG. 1.
Figure 3:
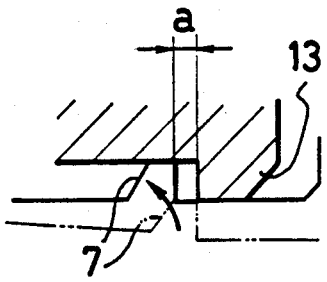
FIG. 3 PRIOR ART
FIG. 3 is an enlarged longitudinal sectional view of a part of the conventional checkable connectors shown in FIG. 2, illustrating a resilient deformation of the detection arm of the male one of the connectors shown in FIG. 2.
Figure 4:
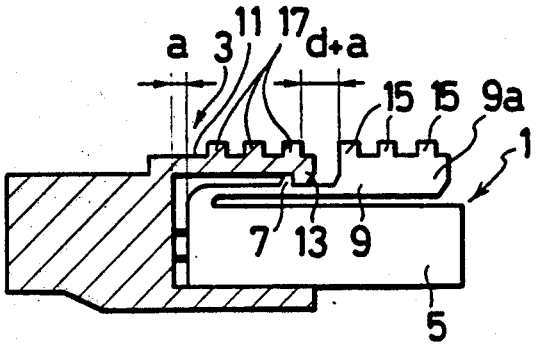
FIG. 4 PRIOR ART
FIG. 4 is a longitudinal sectional view of the conventional checkable connectors shown in FIG. 1, illustrating the gap existing between the front end of the male connector and the innermost end of the female connector of the conventional checkable connectors.

Further, in the checkable connectors 1, 3 of the present invention shown in FIG. 5, since the detection marks 37, 25 of the connectors 1, 3 are disposed in arrangement in the lateral direction perpendicular to the longitudinal direction in which the male connector 1 is moved to the female connector 3 so as to be inserted therein, there is no fear that: a gap (such as that "a" shown in FIGS. 2 and 4), which exists between the male connector 1 and the female connector 3 to extend in the above longitudinal direction, affects the detection marks 37, 25 in spacing. Consequently, it is possible for the checkable connectors 1, 3 of the present invention to enable the detecting unit to determine, without fail, whether or not the connectors 1, 3 are precisely connected with each other.

Figure 9:
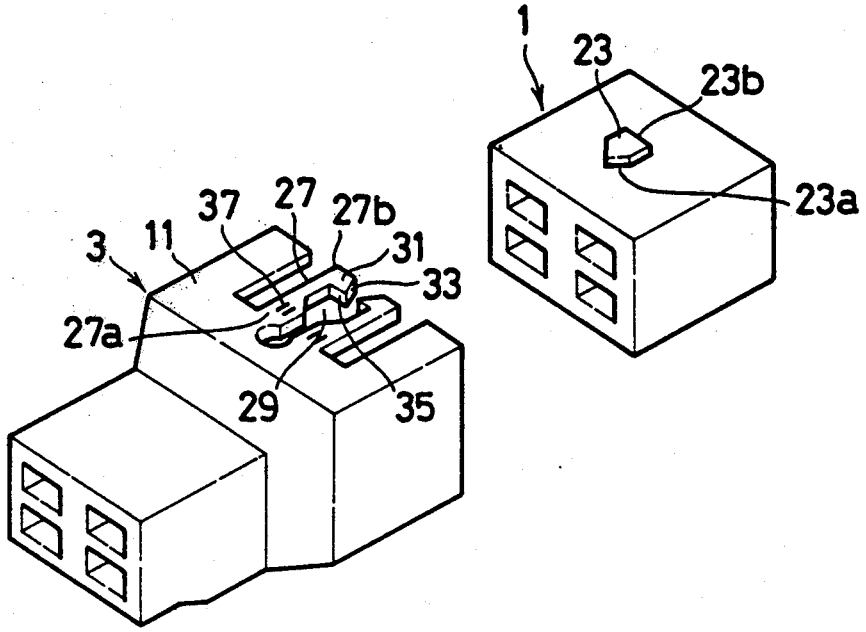
FIG. 9 is a perspective view of a second embodiment of the soft-shell type connection-condition checkable connectors of the present invention.
Figure 10:
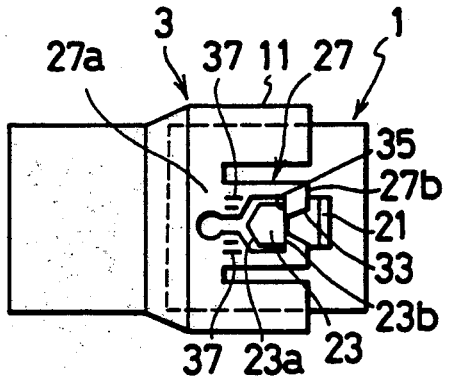
FIG. 10 is a plan view of the second embodiment of the checkable connectors of the present invention shown in FIG. 9, illustrating the connectors having been connected with each other.

FIGS. 9 and 10 show a second embodiment of the connection-condition checkable connector of the present invention.

In the second embodiment of the present invention, as is clear from FIG. 9, the engaging projection 23 of the male connector 1 carries no detection mark on its upper surface in contrast with the first embodiment of the present invention shown in FIG. 5. On the other hand, the female connector 3 of the second embodiment of the present invention carries the detection marks 37 on the upper surfaces of the detection arms 27 as is in the first embodiment shown in FIG. 5. These detection marks 37 are formed on area adjacent to a base portion of the engaging cavity 29 of the second embodiment of the present invention, as is clear from FIG. 10. The remaining construction of the second embodiment of the present invention is substantially the same as that of the first embodiment shown in FIG. 5.

Consequently, in connecting operation of the second embodiment of the present invention, the array or arrangement the detection marks 37 of the connectors 1, 3 of the second embodiment is also deformed in case that the connectors 1, 3 are incompletely connected with each other as is in the first embodiment shown in FIG. 8. As a result, the connectors 1, 3 of the second embodiment of the present invention enables the detecting unit to detect the thus deformed arrangement of the detection marks 37 without fail. Therefore, it is possible for the computer to determine whether or not the connectors 1, 3 of the second embodiment are precisely connected with each other. The second embodiment of the present invention is advantageous in that: since the detection marks 37 are carried or formed on the female connector 3 only, there is no fear that a gap (such as that "a" shown in FIGS. 2 and 4, which "a" exists between the male connector 1 and the female connector 3 to extend in the above longitudinal direction) affects the detection marks 37 in spacing. In addition, as is clear from FIG. 9, the male connector 1 of the second embodiment of the present invention is advantageous in easiness in production and in saving manufacturing cost, since the male connector 1 carries no detection mark.

Figure 11:
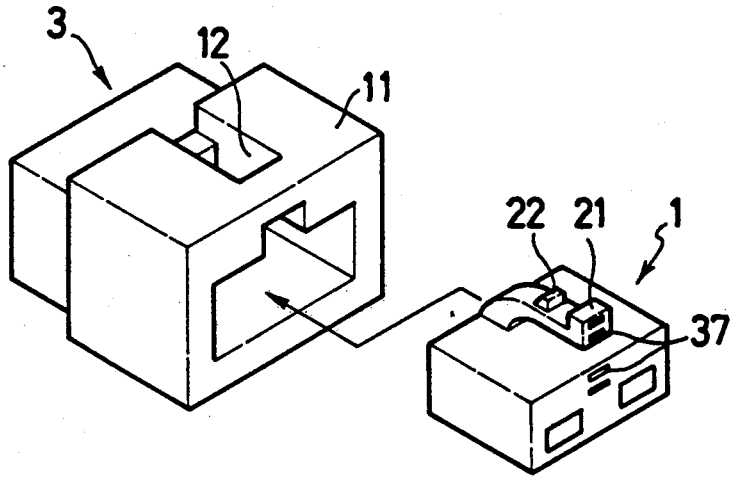
FIG. 11 is a perspective view of a third embodiment of the soft-shell type connection-condition checkable connectors of the present invention.

FIGS. 11 and 12 show a third embodiment of the present invention.

Figure 12A:
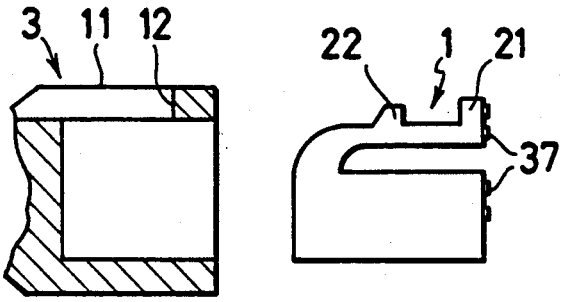
FIG. 12A is a longitudinal sectional view of the third embodiment of the checkable connectors of the present invention shown in FIG. 11, illustrating the connectors being still not connected with each other.

In the third embodiment of the present invention, the male connector 1 is provided with a movable lock arm 21 which has: its intermediate portion formed into an engaging projection 22; and a rear surface of its free-end portion be flush with a rear surface of a main body of the male connector 1, as is clear from FIG. 12A. In these rear surfaces of the male connector 1 are formed the detection marks 37. These marks 37 are spaced side by side apart from each other, while disposed in array or arrangement in a vertical direction perpendicular to an upper surface of the male connector 1. On the other hand, the engaging projection 22 of the movable lock arm 21 of the male connector 1 constructs a part of an abutting means the other part of which is constructed of an engaging cavity 12 formed in the hood portion 11 of the female connector 3.

Figure 12B:
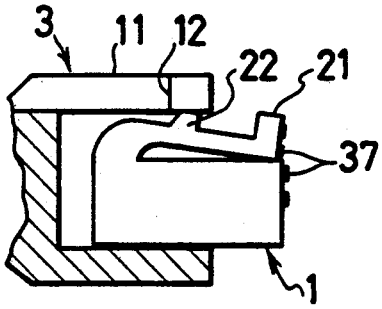
FIG. 12B is a longitudinal sectional view of the third embodiment of the checkable connectors of the present invention shown in FIG. 11, illustrating the male one of the connectors having its detection arm resiliently deformed.
Figure 12C:
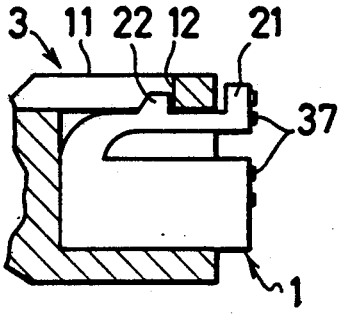
FIG. 12C is a longitudinal sectional view of the third embodiment of the checkable connectors of the present invention shown in FIG. 11, illustrating the connectors having been connected with each other.

In connecting operation of the third embodiment of the present invention, first, as shown in FIG. 12A, the male connector 1 is oppositely disposed from the female connector 3, and then moved thereto. As the male connector 1 is inserted into the female connector 3, as shown in FIG. 12B, the movable lock arm 21 is resiliently deformed to have the engaging projection 22 thereof to enter the engaging cavity 12 of the female connector 3. Then, as shown in FIG. 12C, when the male connector 1 is further inserted into the female connector 3, the engaging projection 22 completely enters the engaging cavity 12 of the female connector 3, so that the connectors 1, 3 of the third embodiment of the present invention are precisely connected with each other.

Consequently, after completion of connection of the connectors 1, 3, it is possible for the detecting unit to detect the arrangement of the detection marks 37 of the male connector 1, whereby the computer can determine without fail whether or not the connectors 1, 3 are precisely connected with each other.

In addition, in the third embodiment of the present invention shown in FIG. 11, it is possible to have the detection marks 37 formed on the male connector 1 by simply attaching an adhesive sheet or tape (which carries the detection marks 37 thereon) to the rear surfaces of the male connector 1.

Incidentally, the present invention is not limited to the above embodiments since certain modifications in carrying out the connectors of the present invention may be made without departing from the scope of the present invention. For example, the detection marks 25, 37 of the connectors may be integrally formed with any other suitable means such as adhesive sheets, tapes, blocks and the like. Further, it is also possible for the detection marks 25, 37 of the connectors to assume any other suitable code forms (depending on properties of the detecting unit such as photo-detectors, acoustic detectors and like detectors), in addition to the bar-code forms described above.

Further, in the male connector 1 of the second embodiment of the present invention shown in FIG. 9, it is also possible to directly form the engaging projection 23 of the male connector 1 on an upper surface of the main body of the male connector 1. Still further, in the second embodiment of the present invention, the engaging projection 23 of the male connector 1 and the hook portions 31 of the detection arms 27 of the female connector 3 constitute a locking mechanism for keeping the connectors 1, 3 connected. However, in case that a separate locking mechanism is provided in the connectors of the present invention, it is also possible for the female connector 3 to use detection arms 27 having no hook portions 31. In this case, it is possible to eliminate the engaging projection 23 from the male connector 1.

What is claimed is:

1. Connection-condition checkable connectors to be electrically interconnected, comprising:

a pair of connector members for being interconnected;

a cantilever-like resilient detection arm provided for one of said connector members, extending along a longitudinal axis which is coincident with a line along which said connector members are moved to be interconnected;

abutting means for resiliently deforming said detection arm in connecting operation so as to move said detection arm temporarily in a direction substantially perpendicular to said line, and then permitting said detection arm to return to its original position; and a plurality of detection marks being provided for said detection arm and said one of said connector members so as to be arranged in a row that extends in a direction substantially perpendicular to said line at an end of one of said connector members opposite to an insertion end thereof.

2. The connection-condition checkable connectors according to claim 1, wherein:

said abutting means comprises a projection provided for said detection arm, and a counter projection provided for the other of said connector members.

3. The connection-condition checkable connectors according to claim 1, wherein:

said detection marks comprise bar codes.

* * * * *